United States Patent [19]

Rodriguez et al.

[11] Patent Number: 4,676,505

[45] Date of Patent: Jun. 30, 1987

[54] BALL PLAYING RACKET WITH FOREARM SUPPORT

[76] Inventors: Arnaldo Rodriguez, 6333 Pacific Ave., Ste. 109, Stockton, Calif. 95207; George Spector, 233 Broadway, Rm. 3815, New York, N.Y. 10007

[21] Appl. No.: 798,575

[22] Filed: Nov. 15, 1985

[51] Int. Cl.[4] ..... A63B 59/00

[52] U.S. Cl. ..... 273/67 B; 273/73 J

[58] Field of Search ..... 273/67 R, 67 B, 76, 273/73 J

[56] References Cited

U.S. PATENT DOCUMENTS

| | | | |
|---|---|---|---|
| 1,523,900 | 1/1925 | Rittenhouse | 273/67 B |
| 1,930,281 | 10/1933 | Ogden | 273/67 R |
| 4,227,692 | 10/1980 | Castelli | 273/67 R |
| 4,516,774 | 5/1985 | Nankivell | 273/67 B |

FOREIGN PATENT DOCUMENTS

| | | | |
|---|---|---|---|
| 2135048 | 2/1973 | Fed. Rep. of Germany | 273/67 R |
| 197803 | 3/1978 | Fed. Rep. of Germany | 273/67 B |
| 3404831 | 8/1985 | Fed. Rep. of Germany | 273/73 J |

*Primary Examiner*—Richard C. Pinkham
*Assistant Examiner*—Gary Jackson

[57] ABSTRACT

A Kylbow racket is provided and consists of a frame with a resilient striking wall that is strapped on the forearm of a player and gripped by a clenched hand so that the wrist of the player will bend when the player uses the racket. In a modified form a striking wall is on either side of the players hand thus allowing for hitting forehand and backhand strokes.

2 Claims, 5 Drawing Figures

BALL PLAYING RACKET WITH FOREARM SUPPORT

BACKGROUND OF THE INVENTION

The instant invention relates generally to hand rackets and more specifically it relates to a Kylbow racket to be employed in playing various games such as racketball, tennis or the like.

Numerous hand rackets have been provided in prior art that are adapted to be secured to the hand. For example, U.S. Pat. Nos. 1,523,899; 1,523,900 and 4,387,895 all are illustrative of such prior art. While these units may be suitable for the particular purpose to which they address, they would not be as suitable for the purposes of the present invention as heretofore described.

SUMMARY OF THE INVENTION

A principle object of the present invention is to provide a Kylbow racket that is pivotally strapped on the forearm of a player and gripped by a clenched hand so that the wrist of the player will not twist and swell up.

Another object is to provide a Kylbow racket that does not have a long handle whereby it is necessary to run faster after the ball, helping to develop speed and will also require more effort/energy from the player forcing the player to exercise more.

An additional object is to provide a Kylbow racket that in a modified form has a striking wall on either side of the players hand thus allowing for hitting forehand and backhand strokes.

A further object is to provide a Kylbow racket that is simple and easy to use.

A still further object is to provide a Kylbow racket that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures thereon are briefly described in the following manner:

DETAILED DESCRIPTION OF THE PREFERRED EMBODIMENTS

Figure 1:
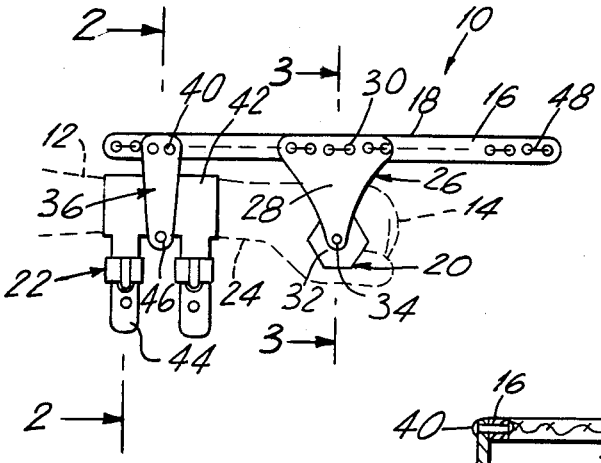
FIG. 1 is a side elevation view of the invention being a racket mounted on a players hand.
Figure 2:
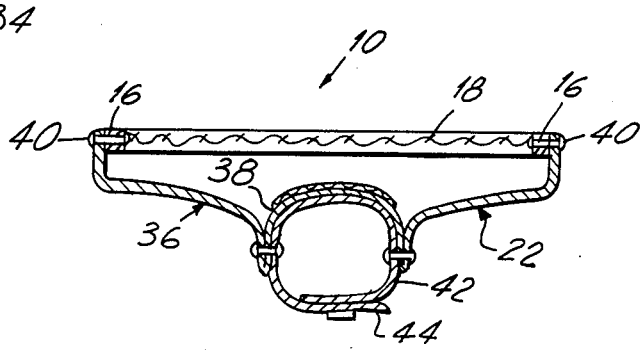
FIG. 2 is a transverse cross sectional view taken along line 2—2 in FIG. 1 through the belt.
Figure 3:
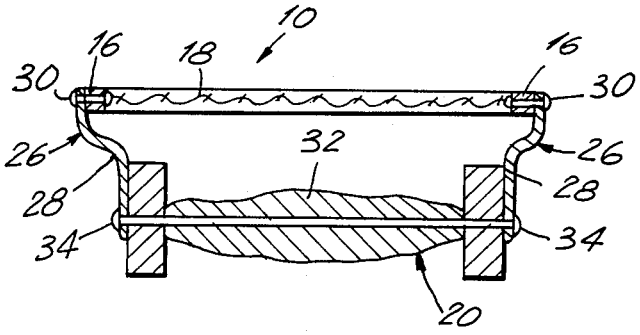
FIG. 3 is a transverse cross sectional view taken along line 3—3 is FIG. 1 through the grip handle.

Turning now descriptively to the drawings, in which similar reference characters denote similar elements throughout the several views, FIGS. 1 through 3 illustrates a Kylbow racket 10 adapted to be secured to a forearm 12 and gripped by a hand 14 of a player. The racket 10 contains a frame 16 that has an opening in which a resilient striking wall 18 extends across the opening within the frame 16.

A structure 20 is for gripping the racket 10 by the hand 14 of the player at center of the frame 16 behind the wall 18. Another structure 22 is for pivotally holding the forearm 12 of the player at one end of the frame 16 behind the wall 18 so that wrist 24 of the player will bend when the player uses the racket 10.

Structure 20 includes a center bridge member 26 that has two portions 28, 28. Each portion 28 is secured at 30 to one side of the frame 16 and extends therefrom. A handle 32 is wecured at 34 and extends between free ends of the portions 28, 28 of the center bridge member 26 so that the hand 14 of the player can grip the handle 32.

Structure 22 includes a rear bridge member 36 that has an inverted U-shaped middle portion 38 with each end secured at 40 to one side of the frame 16 and extends therefrom. A belt 42 that has a double buckle 44 is pivotally secured at 46 to the middle portion 38 of the rear bridge member 36 so that the belt 42 can be strapped to the forearm 12 of the player.

Figure 4:
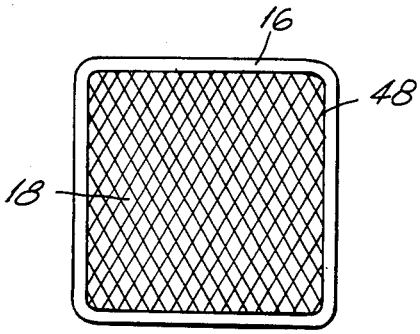
FIG. 4 is a plan view of the racket per se.

FIG. 4 shows the frame 16 being of a generally square form through the form thereof may be varied, as desired. The resilient striking wall 18 is a plurality of woven interlaced strands secured at 48 to the frame 16.

Figure 5:
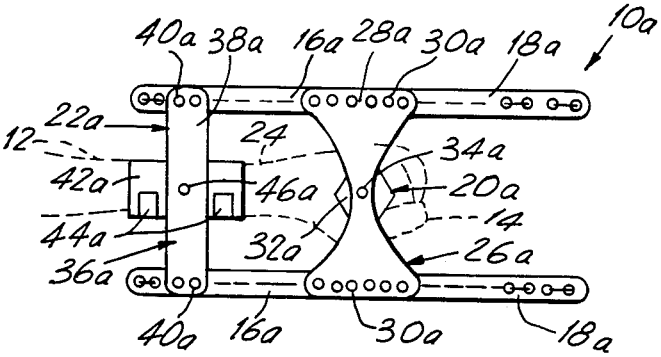
FIG. 5 is a side elevation view of a modified form of the invention mounted for use on the players hand, wherein the invention includes a striking wall on either side of the players hand with the grip handle and the belt mounted on the players forearm and secured between the striking faces thus providing for hitting forehand and backhand strokes.

A modified Kylbow racket **10*a* is shown in FIG. 5 and contains a pair of parallel frames 16*a*, 16*a* each having an opening. A pair of resilient striking walls 18*a*, 18*a* are provided, whereby each extends across one opening within each of the frames 16*a***.

A structure **20*a* is for gripping the racket 10*a* by the hand 14 of the player at center of the frame 16*a*, 16*a* between the walls 18*a*, 18*a*. Another structure 22*a* is for holding the forearm 12 of the player at one end of the frames 16*a*, 16*a* between the walls 18*a*, 18*a* so that wrist 24 of the player will be stationary when the player uses the racket 10*a*** for hitting forehand and backhand strokes.

Structure **20*a* includes a center bridge member 26*a* that has two portions 28*a*, 28*a*. Each portion 28*a* is secured at 30*a* to one side of each of the frames 16*a*, 16*a* and extends therebetween. A handle 32*a* is wecured at 34*a* and extends between middle of the portions 28*a*, 28*a* of the center bridge member 26*a* so that the hand 14 of the player can grip the handle 32**.

Structure **22*a* includes a rear bridge member 36*a* that has two portions 38*a*, 38*a*. Each portion 38*a* is secured at 40*a* to one side of each of the frames 16*a*, 16*a* and extends therebetween. A belt 42*a* that has a double VELCRO buckle 44*a* is secured at 46*a* to middle of the portions 38*a*, 38*a* of the rear bridge member 36*a* so that the belt 42*a* can be strapped to the forearm 12** of the player.

The frames **16*a*, 16*a* and striking walls 18*a*, 18*a* can be of the same construction and shape as the frame 16 and striking wall 18 as shown in FIG. 4** or may be varied, as desired.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A racket adapted to be secured to a forearm and gripped by a hand of a player which comprises:

(a) a frame having an opening;

(b) a resilient striking wall extending across said opening within said frame;

(c) means for gripping said racket by said hand of said player at center of said frame behind said wall; and (d) means for pivotally holding said forearm of said player at one end of said frame behind said wall, wherein said gripping means includes:

(e) a center bridge member having two portions, each said portion secured to one side of said frame and extending therefrom; and (f) a handle secured to and extending between free ends of said portions of said center bridge member so that said hand of said player can grip said handle, wherein said pivotally holding means includes:

(g) a rear bridge member having an inverted U-shaped middle portion with each end secured to one side of said frame and extending therefrom; and (h) a belt having a double buckle pivotally secured to said middle portion of said rear bridge member so that said belt can be strapped to said forearm of said player.

2. A racket adapted to be secured to a forearm and gripped by a hand of a player which comprises:

(a) a pair of parallel frames, each having an opening;

(b) a pair of resilient striking walls, each extending across one said opening within each of said frames;

(c) means for gripping said racket by said hand of said player at center of said frames between said walls; and (d) means for pivotally holding said forearm of said player at one end of said frames between said walls, wherein said gripping means includes:

(e) a center bridge member having two portions, each said portion secured to one side of each of said frames and extending therebetween; and (f) a rear bridge member having two portions, each said portion secured to one side of each of said frames and extending therebetween; and (g) a belt havig a double buckle pivotally secured to middle of said portions of said rear bridge member so that said belt can be strapped to said forearm of said player.

* * * * *